US010586442B1

(12) United States Patent
Jensen et al.

(10) Patent No.: US 10,586,442 B1
(45) **Date of Patent: *Mar. 10, 2020**

(54) HOME ALARM SYSTEM

(71) Applicant: Vivint, Inc., Provo, UT (US)

(72) Inventors: Gavin Jensen, Lehi, UT (US); Jeffrey David Whitlock, Orem, UT (US)

(73) Assignee: Vivint, Inc., Provo, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/231,804

(22) Filed: Dec. 24, 2018

Related U.S. Application Data

(63) Continuation of application No. 15/632,319, filed on Jun. 24, 2017, now Pat. No. 10,163,329.

(51) Int. Cl.

| | |
|---|---|
| ***G08B 25/10*** | (2006.01) |
| ***G08B 25/01*** | (2006.01) |
| ***G08B 25/00*** | (2006.01) |
| ***G08B 13/196*** | (2006.01) |
| ***G08B 19/00*** | (2006.01) |
| ***G08B 27/00*** | (2006.01) |

(52) U.S. Cl.
CPC ..... *G08B 25/10* (2013.01); *G08B 13/19652* (2013.01); *G08B 13/19678* (2013.01); *G08B 13/19691* (2013.01); *G08B 25/002* (2013.01); *G08B 25/008* (2013.01); *G08B 25/009* (2013.01); *G08B 25/01* (2013.01); *G08B 19/00* (2013.01); *G08B 25/00* (2013.01); *G08B 27/003* (2013.01)

(58) Field of Classification Search
CPC ..... G08B 25/00; G08B 13/19652; G08B 13/19691; G08B 25/002
USPC ..... 340/541, 506, 511, 3.1, 539.1, 539.11
See application file for complete search history.

(56) References Cited

U.S. PATENT DOCUMENTS

| | | | | |
|---|---|---|---|---|
| 5,400,246 | A | 3/1995 | Wilson et al. | |
| 6,252,544 | B1 * | 6/2001 | Hoffberg | H04B 7/18576 342/357.31 |
| 7,187,279 | B2 * | 3/2007 | Chung | G08B 13/19645 340/506 |
| 9,355,541 | B1 | 5/2016 | Lewinski | |
| 9,552,711 | B2 | 1/2017 | Peterson et al. | |
| 10,007,783 | B2 * | 6/2018 | Schoenemann | G06F 21/552 |
| 10,163,329 | B1 * | 12/2018 | Jensen | G08B 25/10 |
| 2005/0222820 | A1 * | 10/2005 | Chung | G08B 13/19645 702/188 |
| 2015/0364028 | A1 | 12/2015 | Child et al. | |

(Continued)

FOREIGN PATENT DOCUMENTS

WO 2014159131 A2 10/2014

OTHER PUBLICATIONS

Lee, J. et al., "A Multilevel Home Security System (MHSS)", International Journal of Smart Home, vol. 7, No. 2, Mar. 2013, pp. 49-60.

*Primary Examiner* — Daryl C Pope
(74) *Attorney, Agent, or Firm* — Holland & Hart LLP

(57) ABSTRACT

Techniques are described for selecting an alarm state based at least in part on determining a security event related to security and automation systems. One method includes receiving, from a sensor, a first indication of a security event at the first location, determining a first threat level based on the security event, and activating a first alarm state based at least in part on the first threat level.

20 Claims, 7 Drawing Sheets

(56) References Cited

U.S. PATENT DOCUMENTS

2016/0034688 A1* 2/2016 Schoenemann ..... G06F 21/552
726/23
2018/0020021 A1* 1/2018 Gilmore ..... H04L 63/1408

* cited by examiner

HOME ALARM SYSTEM

CROSS-REFERENCE TO RELATED APPLICATIONS

This application is a continuation application of U.S. patent application Ser. No. 15/632,319 entitled "HOME ALARM SYSTEM" which was filed Jun. 24, 2017, which is incorporated by reference herein.

BACKGROUND

The present disclosure, for example, relates to security and automation systems, and more particularly to providing techniques for determining an alarm state based on a determined threat level.

Security and automation systems are widely deployed to provide various types of communication and functional features such as monitoring, communication, notification, and/or others. These systems may be capable of supporting communication with a user through a communication connection or a system management action.

Present security systems, e.g., for homes and commercial businesses, have become commonplace as people seek to guard themselves and their property. These security systems typically employ an armed or disarmed state, where when a threat is determined, and if the system is armed, the security system initiates a default alarm state.

SUMMARY

The present disclosure addresses the shortcomings of existing security and automation systems by applying parameters to events that may trigger an alarm. In some aspects, events that trigger an alarm may include, but are not limited to, a person entering and/or exiting a property during an armed state of the security and automation system. Personal, family, and home security are the top goals driving smart home adoption for consumers today, with over 90% of consumers agreeing that security is the most important reason to purchase a smart home system. Research shows a clear benefit to having a smart home system for purposes of promoting cost savings, energy efficiency, and security; however, research has also shown that consumers are discouraged by the existing systems' lack of ability to efficiently anticipate needs, lack of ability to adjust to personal preferences, and lack of interactive features to connect users with the systems.

In one embodiment of the current system, a user may interact with a smart home system to control an HVAC system, outdoor and indoor light, cameras (still and motion), audio receipt and broadcasting, locking and unlocking of doors and windows, security settings, and consideration of user preferences of occupants associated with the home, visitors, and potentially neighbors and delivery people.

The methods and systems described herein take into consideration the preferences of the occupants and security situations to determine an appropriate alarm state and security action. For example, the alarm state may vary based on who is currently at home, who is expected home within a pre-determined period, whether a guest is expected, the weather, current situations in the neighborhood, the time of day, the date, whether pets are home, and the like. Based on the current situation, an appropriate security action will be activated. In some cases, the security action may begin with something low key such as a text alert sent to a mobile device and may increase in severity to audible alarms and communications with emergency personnel. The methods and systems may thus aid in deterring intruders, making phone calls for help or to inform occupants of the situations, reduce uncertainty, reduce false alarms, and provide specific and accurate information and actions on an increasing or decreasing threat level scale.

A method for automation and/or security at a first location is described. The method may include receiving, from a sensor, a first indication of a security event at the first location; determining a first threat level based on the security event; and activating a first alarm state based at least in part on the first threat level.

An apparatus for automation and/or security at a first location is described. The apparatus may include a processor, memory in electronic communication with the processor, and instructions stored in the memory. The instructions may cause the processor to receive, from a sensor, a first indication of a security event at the first location; determine a first threat level based on the security event; and activate a first alarm state based at least in part on the first threat level.

A non-transitory computer readable medium for automation and/or security at a first location is described. The non-transitory computer readable medium may store a program that, when executed by a processor, causes the processor to receive, from a sensor, a first indication of a security event at the first location; determine a first threat level based on the security event; and activate a first alarm state based at least in part on the first threat level.

Some embodiments of the method, apparatus, and/or non-transitory computer-readable medium may further include processes, features, means, and/or instructions for: receiving a second indication of a second security event at the first location; determining a second threat level based on the combination of the first security event and the second security event; and activating a second alarm state based on the combination.

In some embodiments of the method, apparatus, and/or non-transitory computer-readable medium described above, the first threat level is based at least in part on user preferences associated with a first occupant and the first security event. In some embodiments of the method, apparatus, and/or non-transitory computer-readable medium described above, receiving the indication of the security event includes determining a presence of an unauthorized person at the first location, determining an unexpected open door, determining an unexpected window, determining an unexpected sound, determining an expected movement, or a combination thereof.

Some embodiments of the method, apparatus, and/or non-transitory computer-readable medium may further include processes, features, means, and or/instructions for sending a report regarding the security event to a user.

In some embodiments of the method, apparatus, and/or non-transitory computer-readable medium described above, the report includes where the security event occurred, when the security event occurred, a video clip containing the security event, an audio clip containing sounds related to the security event, a location of each occupant associated with the location during the security event, a current location of each occupant, or a combination thereof.

The foregoing has outlined rather broadly the features and technical advantages of examples according to this disclosure so that the following detailed description may be better understood. Additional features and advantages will be described below. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein—including their organization and method of operation—together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following a first reference label with a dash and a second label that may distinguish among the similar components. However, features discussed for various components—including those having a dash and a second reference label—apply to other similar components. If only the first reference label is used in the specification, the description is applicable to any one of the similar components having the same first reference label irrespective of the second reference label.

DETAILED DESCRIPTION

The techniques described herein generally relate to addressing the shortcomings of existing security and automation systems. In one aspect, the techniques described relate to determining the occurrence of a security event which may trigger an alarm associated with a security and automation system. In some aspects, a security event may include the determining the presence of an unexpected or unauthorized person entering and/or exiting a property. In some cases, a person may be authorized, but may be entering and exiting during an unauthorized time period; for example a guest, a worker, or a delivery person may be recognized by the system as authorized during daytime hours, but not during the evening. Other events may include the opening of a door or window in an unexpected manner or during an unexpected time. Still other events may include the sound of glass breaking, detection of fire, smoke, or carbon monoxide; security events occurring nearby at a neighbor's house or a nearby store; excessive or unexpected pet noise, and the like.

Based on the security event, the system may initiate an alarm state. The alarm state may be based on the severity of the security event, and may be further based on the number of security events detected or the sequence of security events detected. Furthermore, based on user preferences for each occupant, the alarm state may vary for each detected occupant even if the security event is the same. For each alarm state, an action or a series of actions may be enabled. For example, based on at least the security event, and in some cases user preferences, the actions may include no actions, push notifications to a mobile device or a control pant, voice and audio alerts, blinking or flashing lights, activation of different colors of lights, lights which change in intensity or duration, partial audio alarms, full audio alarms, communication with occupants, neighbors, preferred contacts, and emergency personnel. In some cases, the action may include activating an interactive display panel to enable an occupant to input information or select an action The following description provides examples and is not limiting of the scope, applicability, and/or examples set forth in the claims. Changes may be made in the function and/or arrangement of elements discussed without departing from the scope of the disclosure. Various examples may omit, substitute, and/or add various procedures and/or components as appropriate. For instance, the methods described may be performed in an order different from that described, and/or various steps may be added, omitted, and/or combined. Also, features described with respect to some examples may be combined in other examples.

Figure 1:
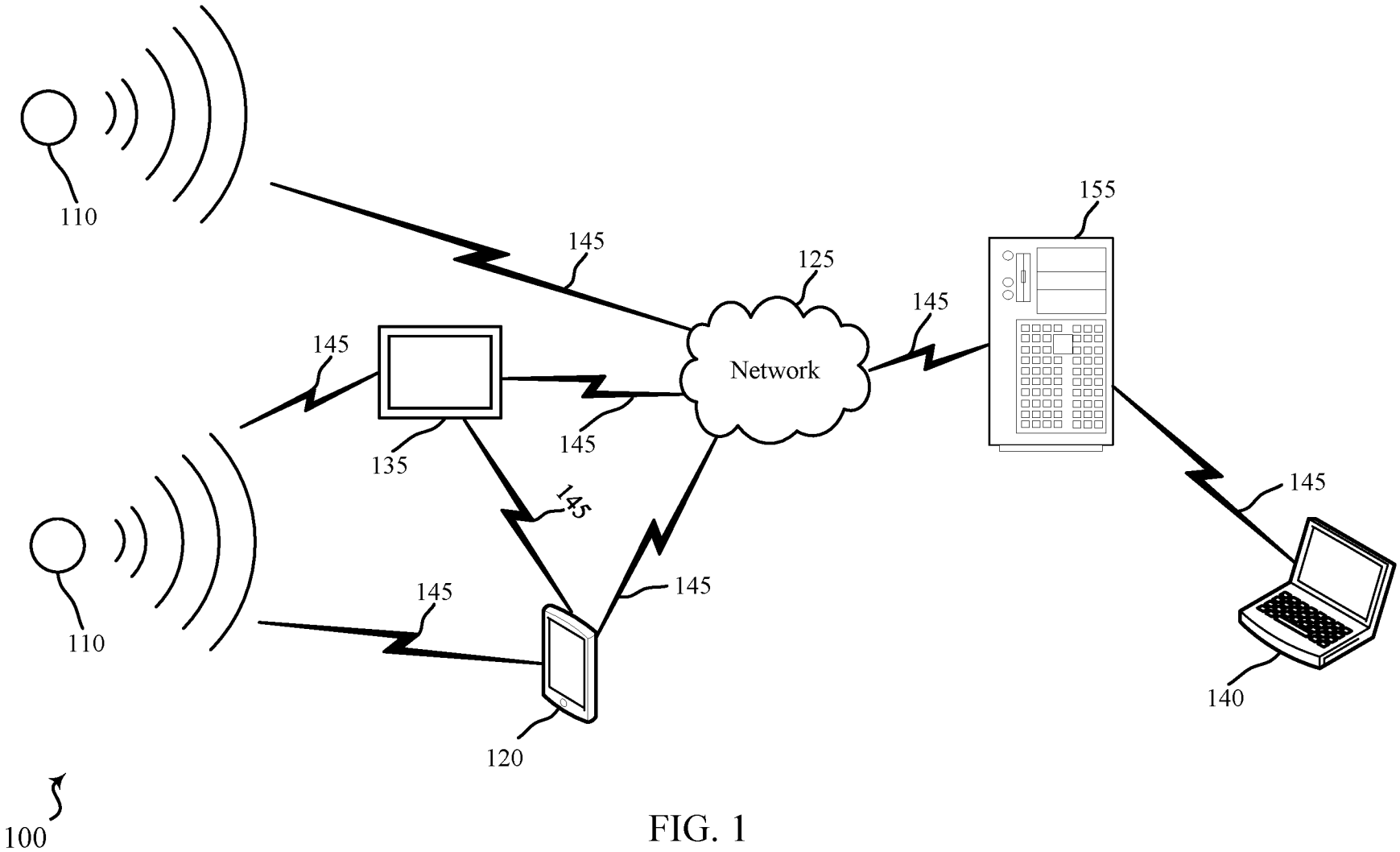
FIG. 1 shows a block diagram relating to an example security and automation system, in accordance with one or more aspects of the present disclosure.

FIG. 1 shows a block diagram relating to an example security and automation system 100, in accordance with one or more aspects of the present disclosure. The security and automation system 100 may include one or more sensor units 110, local computing device 120, control panel 135, remote computing device 140, and server 155. The network 125 may provide user authentication credentials, encryption, access authorization, tracking, Internet Protocol (IP) connectivity, and other access, computation, modification, and/or functions. The control panel 135 may interface with the network 125 through a first set of wired and/or wireless communication links 145 to communicate with the server 155. The control panel 135 may perform communication configuration, adjustment, and/or scheduling for communication with the local computing device 120 and remote computing device 140, or may operate under the control of a controller. Control panel 135 may communicate with a back end server (such as the server 155)—directly and/or indirectly—using the first set of one or more wireless communication links 145. In some examples, the server 155 may be a remote server located at a location different or same from the control panel 135, the local computing device 120, and/or the remote computing device 140.

The control panel 135 may wirelessly communicate with the remote computing device 140 and the local computing device 120 by way of one or more antennas. The control panel 135 may provide communication coverage for a respective coverage area (e.g., residential, commercial). In some examples, control panel 135 may be referred to as a control device, a controller, a base transceiver station, a radio base station, an access point, a radio transceiver, or some other suitable terminology. The coverage area for a control panel 135 may be divided into sectors or zones making up only a portion of the coverage area. The security and automation system 100 may include control panels of different types. In some examples, the security and automation system 100 may include overlapping coverage areas for one or more different parameters, including different technologies, features, subscriber preferences, hardware, software, technology, and/or methods. For example, one or more control panels may be related to one or more discrete structures (e.g., a home, a business) and each of the one more discrete structures may be related to one or more discrete areas. In other examples, multiple control panels may be related to the same one or more discrete structures (e.g., multiple control panels relating to a home and/or a business complex). For example, one or more control panels may be located within a home. Additionally or alternatively, each room within the home may have a designated control panel located within each room. In some cases, the one or more control panels may communicate with one another via one or more communication protocols. In some examples, the one or more control panels may form a mesh network within the home and communicate with one another via the mesh network. In some examples, a control panel may modify or update a security parameter based on information received from one or more other control panels in the mesh network.

The local computing device 120 or remote computing device 140 may be dispersed throughout the security and automation system 100. In some examples, the local computing device 120 and/or remote computing device 140 may be stationary and/or mobile. In some examples, the local computing device 120 and/or remote computing device 140 may include a cellular phone, a personal digital assistant (PDA), a wireless modem, a wireless communication device, a handheld device, a tablet computer, a laptop computer, a cordless phone, a wireless local loop (WLL) station, a display device (e.g., TVs, computer monitors, etc.), a printer, a camera, and/or the like. The local computing device 120 and/or remote computing device 140 may, additionally or alternatively, include or be referred to by those skilled in the art as a user device, a smartphone, a BLUETOOTH® device, a Wi-Fi device, a mobile station, a subscriber station, a mobile unit, a subscriber unit, a wireless unit, a remote unit, a mobile device, a wireless device, a wireless communications device, a remote device, an access terminal, a mobile terminal, a wireless terminal, a remote terminal, a handset, a user agent, a mobile client, a client, and/or some other suitable terminology.

In some examples, control panel 135 may be a smart home system panel, for example, an interactive panel mounted on a wall or other surface in a person's home. Control panel 135 may be in direct communication via wired or wireless communication links 145 with the one or more sensor units 110, or may receive sensor data from the one or more sensor units 110 via local computing device 120 and network 125, or may receive data via remote computing device 140, server 155, and network 125. Additionally or alternatively, the control panel 135 may wirelessly communicate with the sensor units 110 via one or more antennas. The sensor units 110 may be dispersed throughout the security and automation system 100 and each sensor unit 110 may be stationary and/or mobile. Sensor units 110 may include and/or be one or more sensors that sense: proximity, motion, temperatures, humidity, sound level, smoke, structural features (e.g., glass breaking, window position, door position), time, light, geo-location data of a user and/or a device, distance, biometrics, weight, speed, height, size, preferences, light, darkness, weather, time, system performance, and/or other inputs that relate to a security and/or an automation system. The local computing device 120, remote computing device 140, and/or a sensor units 110 may be able to communicate through one or more wired and/or wireless connections with various components such as a control panel, base stations, and/or network equipment (e.g., servers, wireless communication points, etc.) and/or the like. In some examples, one or more sensor units 110 may be located within a structure, e.g., home. Additionally or alternatively, in some examples, the structure may have a designated sensor unit located within one or more predetermined areas, e.g., rooms. In some cases, the one or more sensor units 110 may communicate with one another via one or more communication protocols. In some examples, the one or more sensor units 110 may form a mesh network within the structure and communicate with one another via the mesh network. In some examples, the mesh network associated with the sensor units 110 may be different or be a part of a mesh network associated with one or more control panels.

The wireless communication links 145 shown in the security and automation system 100 may include uplink (UL) transmissions from a local computing device 120 to a control panel 135, and/or downlink (DL) transmissions, from a control panel 135 to the local computing device 120. The downlink transmissions may also be called forward link transmissions while the uplink transmissions may also be called reverse link transmissions. Wireless communication links 145 may include one or more carriers, where each carrier may be a signal made up of multiple sub-carriers (e.g., waveform signals of different frequencies) modulated according to the various radio technologies. Each modulated signal may be sent on a different sub-carrier and may carry control information (e.g., reference signals, control channels, etc.), overhead information, user data, etc. The wireless communication links 145 may transmit bidirectional communications and/or unidirectional communications. Wireless communication links 145 may include one or more connections, including but not limited to, 345 MHz, Wi-Fi, BLUETOOTH®, BLUETOOTH® Low Energy, cellular, Z-WAVE®, 802.11, peer-to-peer, LAN, wireless local area network (WLAN), Ethernet, FireWire®, fiber optic, and/or other connection types related to security and/or automation systems.

In some aspects, of the security and automation system 100, control panel 135, local computing device 120, and/or remote computing device 140 may include one or more antennas for employing antenna diversity schemes to improve communication quality and reliability between control panel 135, local computing device 120, and remote computing device 140. Additionally or alternatively, control panel 135, local computing device 120, and/or remote computing device 140 may employ multiple-input, multiple-output (MIMO) techniques that may take advantage of multi-path, mesh-type environments to transmit multiple spatial layers carrying the same or different coded data.

While the local computing device 120 and/or remote computing device 140 may communicate with each other through the control panel 135 using wireless communication links 145, the local computing device 120 and/or remote computing device 140 may also communicate directly with one or more other devices via one or more direct communication links (not shown). Examples of direct communication links may include Wi-Fi Direct, BLUETOOTH®, wired, and/or, and other P2P group connections. The control panel 135, local computing device 120, and/or remote computing device 140 in these examples may communicate according to the WLAN radio and baseband protocol including physical and medium access control (MAC) layers from IEEE 802.11, and its various versions including, but not limited to, 802.11b, 802.11g, 802.11a, 802.11n, 802.11ac, 802.11ad, 802.11ah, etc. In other implementations, other peer-to-peer connections and/or ad hoc networks may be implemented within security and automation system 100.

In an example, local computing device 120 and remote computing device 140 may be custom computing entities configured to interact with sensor units 110 via network 125, and in some embodiments, via server 155. In other embodiments, local computing device 120 and remote computing device 140 may be general purpose computing entities such as a personal computing device, for example, a desktop computer, a laptop computer, a netbook, a tablet personal computer (PC), a control panel, an indicator panel, a multi-site dashboard, an iPod®, an iPad®, a smart phone, a mobile phone, a personal digital assistant (PDA), and/or any other suitable device operable to send and receive signals, store and retrieve data, and/or execute modules. The local computing device 120 may include memory, a processor, an output, a data input and a communication module. The processor may be a general purpose processor, a Field Programmable Gate Array (FPGA), an Application Specific Integrated Circuit (ASIC), a Digital Signal Processor (DSP), and/or the like. The processor may be configured to retrieve data from and/or write data to the memory. The memory may be, for example, a random access memory (RAM), a memory buffer, a hard drive, a database, an erasable programmable read only memory (EPROM), an electrically erasable programmable read only memory (EEPROM), a read only memory (ROM), a flash memory, a hard disk, a floppy disk, cloud storage, and/or so forth. In some embodiments, the local computing device 120 may include one or more hardware-based modules (e.g., DSP, FPGA, ASIC) and/or software-based modules (e.g., a module of computer code stored at the memory and executed at the processor, a set of processor-readable instructions that may be stored at the memory and executed at the processor) associated with executing an application, such as, for example, receiving and displaying data from sensor units 110.

The processor of the local computing device 120 may be operable to control operation of the output of the local computing device 120. The output may be a television, a liquid crystal display (LCD) monitor, a cathode ray tube (CRT) monitor, speaker, tactile output device, and/or the like. In some embodiments, the output may be an integral component of the local computing device 120. Similarly, the output may be directly coupled to the processor. For example, the output may be the integral display of a tablet and/or smart phone. In some embodiments, an output module may include, for example, a High Definition Multimedia Interface™ (HDMI) connector, a Video Graphics Array (VGA) connector, a Universal Serial Bus™ (USB) connector, a tip, ring, sleeve (TRS) connector, and/or any other suitable connector operable to couple the local computing device 120 to the output.

The remote computing device 140 may be a computing entity operable to enable a remote person to monitor the output of the sensor units 110. The remote computing device 140 may be functionally and/or structurally similar to the local computing device 120 and may be operable to receive data streams from and/or send signals to at least one of the sensor units 110 via the network 125. The network 125 may be the Internet, an intranet, a personal area network, a local area network (LAN), a wide area network (WAN), a virtual network, a telecommunications network implemented as a wired network and/or wireless network, etc. The remote computing device 140 may receive and/or send signals over the network 125 via wireless communication links 145 and server 155.

In some embodiments, the sensor units 110 may be sensors configured to conduct periodic or ongoing automatic measurements related to detecting an occurrence of an event. In some examples, the sensor units 110 may be configured to determine presence, occupancy, identity, and location based on a received request. Each sensor unit 110 may be capable of sensing multiple identification and/or location determining parameters, or alternatively, separate sensor units 110 may monitor separate identification and/or location determining parameters. For example, one sensor unit 110 may determine an identity of a person, while another sensor unit 110 (or, in some embodiments, the same sensor unit 110) may detect an occupancy of and/or location of the person.

In some embodiments, the sensor units 110 may be separate from the control panel 135 and may be positioned at various locations throughout the house or the property. In other embodiments, the sensor units 110 may be integrated or collocated with other house and/or building automation system components, home appliances, and/or other building fixtures. For example, a sensor unit 110 may be integrated with a doorbell or door intercom system, or may be integrated with a front entrance light fixture. In other embodiments, a sensor unit 110 may be integrated with a wall outlet and/or switch. In other embodiments, the sensor units 110 may be integrated and/or collocated with the control panel 135 itself. In some examples, each of the sensor units 110, control panel 135, and/or local computing device 120 may comprise a speaker unit, a microphone unit, and/or a camera unit, among other things.

In some cases, a property may be monitored by the control panel 135 and/or sensor units 110. In some examples, the control panel 135 may include sensor units 110 such that the control panel 135 may directly receive signals (e.g., motion sensed, entry/exit detected) associated with the property. Each sensor unit 110 may be capable of sensing multiple occupancy parameters, or alternatively, separate sensor units may monitor separate occupancy parameters. For example, one sensor unit may be a motion sensor, while another sensor unit may detect security parameters by monitoring vibration or audio. In some cases, sensor units 110 may additionally monitor alternate security and occupancy parameters, for example by monitoring heartbeat or breathing. In some examples, occupancy may be detected by any one of a motion sensor, audio sensor, RFID sensor, video camera, light-break sensor, or a combination thereof. In some embodiments, the sensor units 110 may be separate from the control panel 135, and may be positioned at various locations, also referred to herein as zones, throughout a property. In other embodiments, the sensor units 110 may be integrated or collocated with other security and automation system components. For example, a sensor unit 110 may be integrated with a wall, door, and/or window for detecting entry and/or exit of a person relative to the property. In other embodiments, the sensor units 110 may be integrated or collocated with the control panel 135 itself.

In some embodiments, data gathered by the sensor units 110 may be communicated to local computing device 120, which may be a thermostat or other wall-mounted input/output smart home display. In other embodiments, local computing device 120 may be a personal computer or smart phone. Where local computing device 120 is a smart phone, the smart phone may have a dedicated application directed to transmitting a request to activate or deactivate a security function of the security and automation system 100. In some embodiments, local computing device 120 may communicate with remote computing device 140 or control panel 135 via network 125 and server 155. Examples of network 125 may include cloud networks, local area networks (LAN), wide area networks (WAN), virtual private networks (VPN), wireless networks (using 802.11, for example), and/or cellular networks (using 3G and/or LTE, for example), etc. In some configurations, the network 125 may include the Internet. In some embodiments, a user may access the functions of local computing device 120 from remote computing device 140. For example, in some embodiments, remote computing device 140 may include a mobile application that interfaces with one or more functions of local computing device 120 or control panel 135.

The server 155 may be configured to communicate with the sensor units 110, the local computing device 120, the remote computing device 140, and control panel 135. The server 155 may perform additional processing on signals received from the sensor units 110 or local computing device 120, or may simply forward the received information to the remote computing device 140 and control panel 135. Additionally or alternatively, server 155 may be a computing device operable to receive data streams (e.g., from sensor units 110 and/or local computing device 120 or remote computing device 140), store and/or process data, and/or transmit data and/or data summaries (e.g., to remote computing device 140). For example, server 155 may receive identification data from a sensor unit 110 and location data from the same and/or different sensor units 110. In some embodiments, server 155 may "pull" the data (e.g., by querying the sensor units 110, the local computing device 120, and/or the control panel 135). In some embodiments, the data may be "pushed" from the sensor units 110 and/or the local computing device 120 to the server 155. For example, the sensor units 110 and/or the local computing device 120 may be configured to transmit data as it is generated by or entered into that device. In some instances, the sensor units 110 and/or the local computing device 120 may periodically transmit data (e.g., as a block of data or as one or more data points).

The server 155 may include a database (e.g., in memory) containing location, identification and/or authentication data received from the sensor units 110 and/or the local computing device 120. Additionally, as described in further detail herein, software (e.g., stored in memory) may be executed on a processor of the server 155. Such software (executed on the processor) may be operable to cause the server 155 to monitor, process, summarize, present, and/or send a signal associated with resource usage data.

Figure 2:
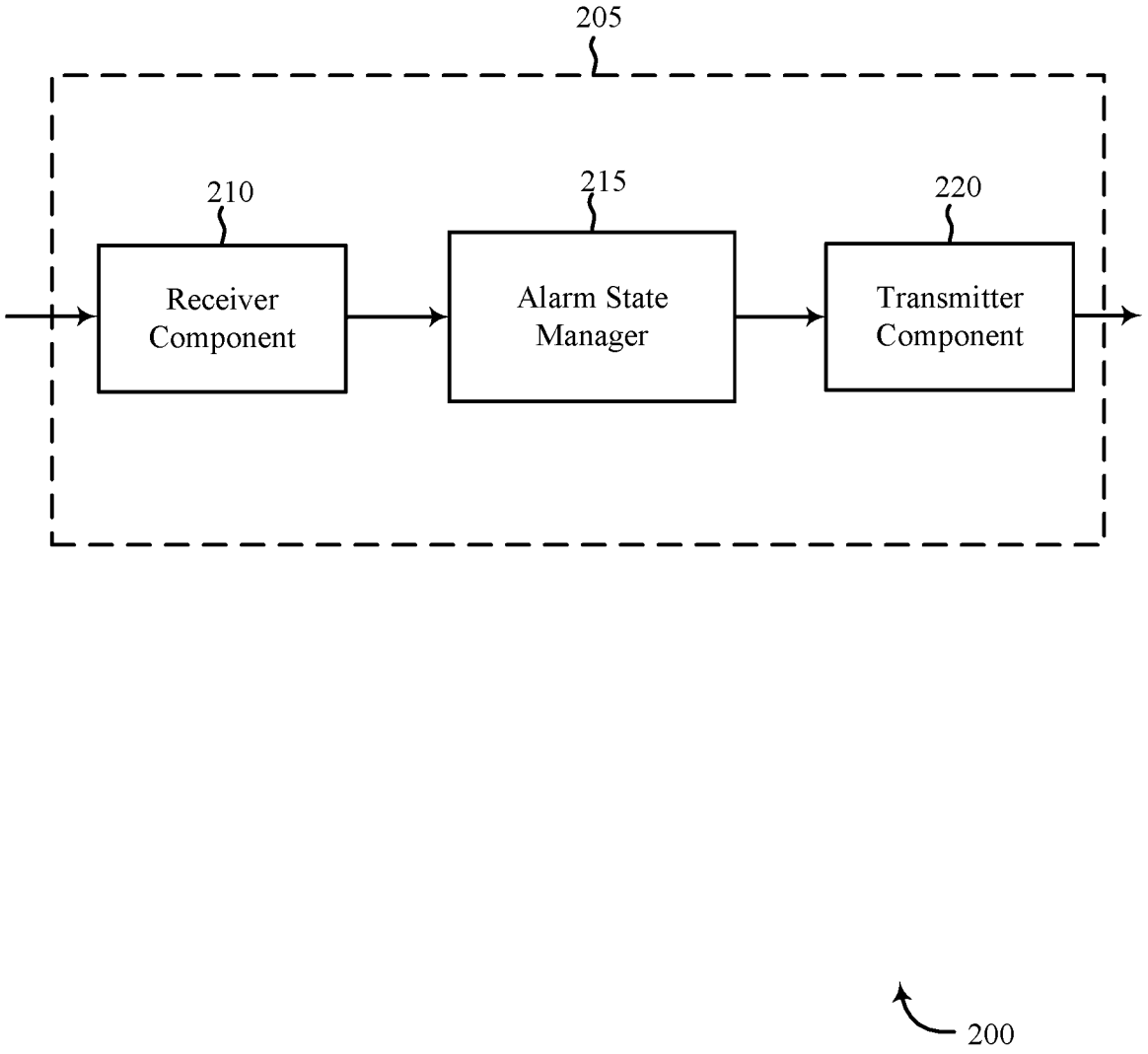
FIG. 2 shows a block diagram of an example apparatus relating to a security and automation system, in accordance with one or more aspects of the present disclosure.

FIG. 2 shows a block diagram 200 of an example apparatus 205 relating to a security and automation system, in accordance with one or more aspects of the present disclosure. The apparatus 205 may be an example of one or more aspects of a control panel 135 described with reference to FIG. 1. The apparatus 205 may include a receiver component 210, an alarm state manager 215, and/or a transmitter component 220. The apparatus 205 may also be or include a processor. Each of these components or modules may be in communication with each other—directly and/or indirectly.

In one embodiment, where apparatus 205 is a control panel, apparatus 205 may be a control panel in the form of an interactive home automation system display. In some embodiments, apparatus 205 may be a local computing device 120 such as a personal computer or portable electronic device (e.g., smart phone, smart watch, tablet computer). In some embodiments, apparatus 205 may be coupled to at least one sensor unit 110.

The components of the apparatus 205 may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The receiver component 210 may receive information such as packets, user data, and/or control information associated with various information channels (e.g., control channels, data channels, etc.). In some examples, the receiver component 210 may be configured to receive instructions at the apparatus 205. In one aspect, the receiver component 210 may be configured to receive an instruction from local computing device 120 and/or remote computing device 140. In some examples, the received instruction may be in the form of a verbal command and/or a tactile input. In further examples, the receiver component 210 may receive identification information, location information and/or authentication credentials from the sensor units 110, local computing device 120, remote computing device 140, and/or server 155. In some examples, information (e.g., authentication credentials, location information) may be passed on to the alarm state manager 215, and to other components of the apparatus 205.

The alarm state manager 215 may receive an indication of a security event at a location associated with the control panel 135; for example, the location may be a house. In other embodiments, however, the location may be a specific room within the house, curtilage, a commercial location, and the like. The indication of a security event may be a single occurrence, multiple occurrences, or a sequence of occurrences. After receiving the indication of the security event, the alarm state manager 215 may determine one or more settings associated with the security and automation system 100. The settings may be based on a determined current occupancy, an anticipated occupancy, user preferences, and the like. Based on the security event and the settings, the alarm state manager 215 may determine a threat level. Based on the determined threat level, the alarm state manager 215 may activate an alarm state, where the alarm state may result in a security action or a series of actions.

In some cases, a property may be monitored by the apparatus 205 and/or in conjunction with the sensor units 110. In some examples, the apparatus 205 may include sensor units 110 such that the apparatus 205 may directly receive signals (e.g., motion sensed, entry/exit detected) associated with the property. Apparatus 205 may additionally, individually or in combination with other sensor units, monitor separate and/or multiple occupancy parameters. For example, apparatus 205 may include a sensor unit 110, such as a motion sensor, where a separate, remote sensor unit may vibration or audio. In some embodiments, the sensor units 110 may be separate from the apparatus 205, and may be positioned at various locations or zones throughout a property and curtilage.

In some cases, the alarm state manager 215 may be in communication with sensor units located at other properties, such as properties within the neighborhood or within a pre-determined geographic range. The other properties may be defined by a geo-fence, or may be defined by subdivision, city, or county boundaries.

Figure 3:
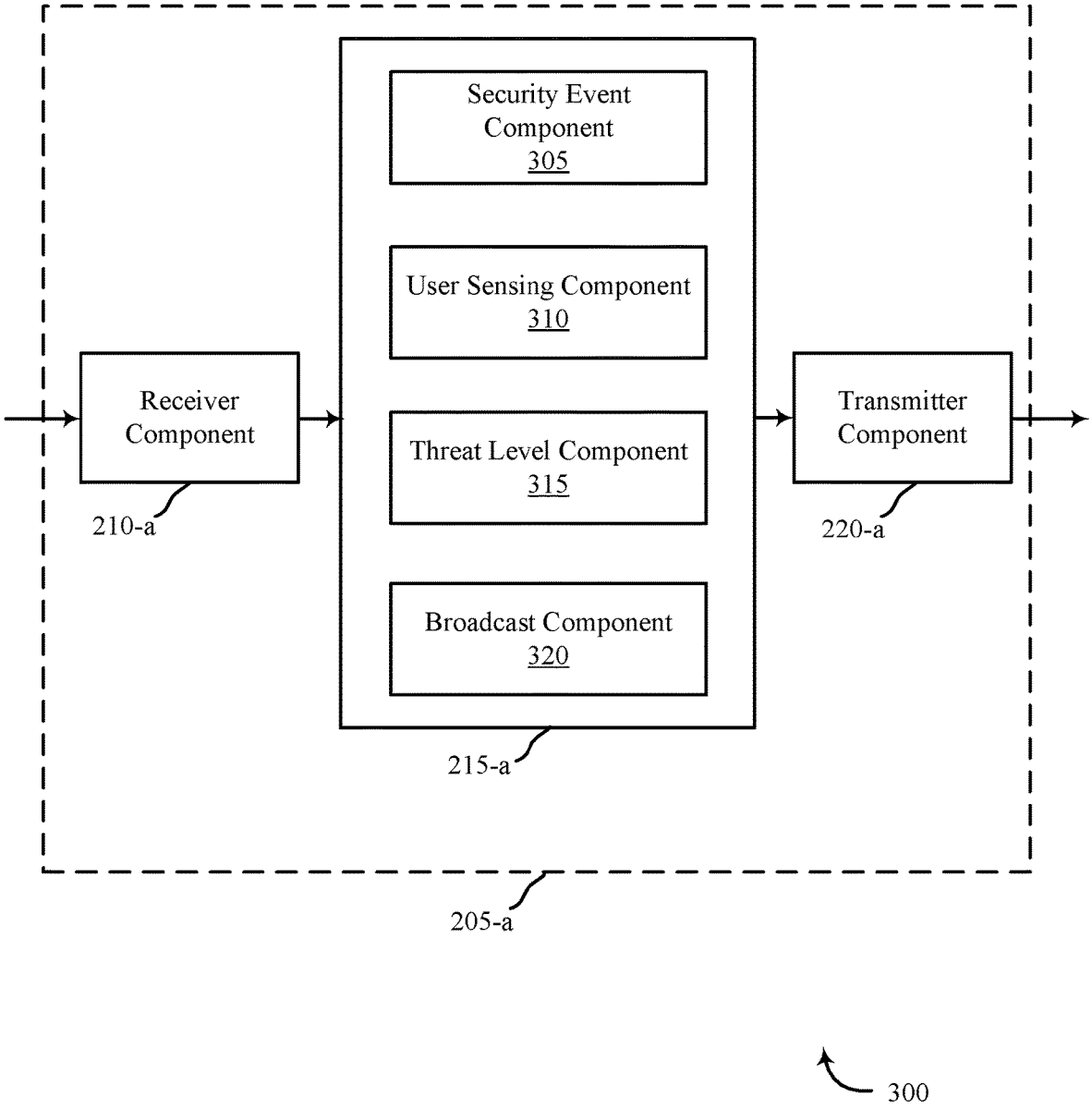
FIG. 3 shows a block diagram relating to an example security and automation system, in accordance with one or more aspects of the present disclosure.

FIG. 3 shows a block diagram 300 relating to an example a security and automation system, in accordance with one or more aspects of the present disclosure. The apparatus 205-*a* may be an example of one or more aspects of a control panel 135 described with reference to FIG. 1. The apparatus 205-*a* may include a receiver component 210-*a*, an alarm state manager 215-*a*, and/or a transmitter component 220-*a*. The apparatus 205-*a* may also be or include a processor. In some aspects, apparatus 205-*a* may be an example of one or more aspects of apparatus 205 described with reference to FIG. 2. Each of these components or modules may be in communication with each other—directly and/or indirectly. In one embodiment, where apparatus 205-*a* is a control panel, apparatus 205-*a* may be a control panel in the form of an interactive home automation system display. In some embodiments, apparatus 205-*a* may be a local computing device 120 such as a personal computer or portable electronic device (e.g., smart phone, smart watch, tablet computer). In some embodiments, apparatus 205 may be coupled to at least one sensor unit 110.

In some examples, the alarm state manager 215-*a*, may include security event component 305, user sensing component 310, threat level component 315, and/or broadcast component 320. In some aspects, the alarm state manager 215-*a* may be an examples of one or more aspects of alarm state manager 215 described with reference to FIG. 2. The components of the apparatus 205-*a* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The receiver component 210-*a* may receive information such as packets, user data, and/or control information associated with various information channels (e.g., control channels, data channels, etc.). In some examples, the receiver component 210-*a* may be configured to receive instructions at the apparatus 205-*a*. In one aspect, the receiver component 210-*a* may be configured to receive instruction from local computing device 120 and/or remote computing device 140. In some examples, the received instruction may be in the form of a verbal command or tactile input. In further examples, the receiver component 210-*a* may receive identification information, location information and/or authentication credentials from the sensor units 110, local computing device 120, remote computing device 140, and/or server 155. In some examples, information (e.g., authentication credentials, location information) may be passed on to the alarm state manager 215-*a*, and to other components of the apparatus 205-*a*. In some aspects, the receiver component 210-*a* may be an example of one or more aspects of the receiver component 210-*a* described with reference to FIG. 2.

The transmitter component 220-*a* may transmit the one or more signals received from other components of the apparatus 205-*a*. The transmitter component 220-*a* may transmit information collected by sensors such as actions or behaviors, times of entry or exits associated with a property, notifications and alerts, communications with third parties, and the like. In some examples, the transmitter component 220-*a* may be collocated with the receiver component 210-*a* in a transceiver module. In some aspects, transmitter component 220-*a* may be an example of one or more aspects of transmitter component 220 with reference to FIG. 2.

In some examples, the security event component 305 may receive data or information from at least one of the sensors 110 of an event or situation which may be indicative of a security breach, safety situation, or an anomaly that may be addressed. In some examples, the sensors 110 may continuously sense for security events, without a time out period. In other examples, the sensors 110 may operate on a periodic state, or may activate based on a change of light, pressure, sound, movement, scent, and the like. In order to aid in accurate security event determination, events, motion, sounds, etc. detected by the sensors 110 may be tagged by occupants. For example, the sound of a certain pet barking may be tagged, or the biometrics of authorized and unauthorized users may be tagged. The tagging may aid in computer learning for future automated decision making by the system. In other examples, the security event component 305 may receive data or information from one of the occupants manually inputting or transmitting data to the alarm state manager 215-*a*.

In some examples, security events may be detected with the system is in an "armed" state. In some cases, the occupants may opt-in to an armed state, whereas in other cases, the security state defaults to an armed state and occupants opt-out if desired.

In some examples, security events may be associated with determining the presence of an unauthorized person (e.g., delivery person, unauthorized guest, stranger, etc.), a door opening, a window opening, glass breaking, data indicative of a fire or excessive carbon monoxide presence, sirens, sounds of crying or screaming, other sounds of struggles or emergencies, flooding, power outages, pet alerts, and the like. In some embodiments, different occupants may have different opinion on what may be considered a security event, or may have different opinions on what level of danger a security threat poses. For example, a house may be occupied by a mother, a father, a teenage son, and a younger daughter. The father may be in the habit of locking all doors and windows and may believe that any anomalies are a cause for concern. Thus, even a low level security event such as a motion detector going off in the yard may trigger a threat level if the father is home, even if the motion detector is detecting a branch moving in stormy weather. In contrast, the mother may have a more lax belief in security events, and when the mother is home, detected security events such as a motion detector activating may only trigger a threat level if the mother is home alone. In other embodiments, the security event may not change, but the threat level may change based on the occupancy; for example, the threat level for a motion detector activating may differ if only the children are home versus if all four members of the family are home.

In some examples, user sensing component 315 may determine the presence of occupants in the home, but may also determine user preferences for each occupant to accurately determine whether a detected event is a security event, and if the event is a security event, determine an appropriate threat level. User sensing component 315 may use identification techniques such as biometrics, manual input, RFID identification, geo-fencing, downloading occupants' schedules from computing devices, motion and vibration sensors, cameras and microphones, etc., to determine the presence and location of occupants and other authorized (and in some cases unauthorized) users.

User sensing component 315 may facilitate user preferences with respect to security events, threat levels, and alarm states. Users or occupants may be identified by the system using identification techniques such as biometric identification, manual input, identifying the presence of computing devices associated with an occupant, and the like. Occupants may provide the system with user preferences regarding security events, threat levels, and resulting alarm actions. The system may also learn user preferences over time. In some cases, user preferences establish default settings for the security and automation system for different situations and when determining the location of various occupants.

Threat level component 315 may determine an appropriate threat level based at least in part on the detected security event or events, user preferences, and other situations. For each security system, there may be a default set of threat levels; however, occupants may input personal preferences into the system to customize the number of threat levels and which security events (including when, where, who, etc.) are indicative of which of the threat levels. In other cases, as the system determines security events, and occupant responses and behaviors to the determined security events, the system may learn which events are considered security events, which security events fall into which threat level, and what a subsequent response to the threat level may be. For example, the mother may originally input into the system that she wishes to categorize the activation of a motion sensor as a medium threat level event; however, every time the motion sensor activates, and the threat level is set to medium, the mother inputs an "ignore" command into the control panel 135. Over time, therefore, the system may learn that the mother does not consider activation of a motion sensor to be a medium threat level, but rather a low threat level.

In one example, a low threat level may be determined based on security events that have been determined to warrant attention, but are not dangerous or imminent. For example, unexpected sounds outside, an unlocked door, or a neighbor sending out an alert may qualify for a low threat level. In another example, the same events may qualify for a medium threat level if only the teenage son or young daughter is home alone. When a low threat level is determine, the system may initiate an alarm state which corresponds to information and notification, but not to evasive or emergency actions; for example, compiling an event summary and report indicating when, where, and what the event was, recording video and audio clips for current or later viewing, determining the location and/or status of occupants, increasing monitoring, increasing the sensitivity of sensors, turn on lights, feign additional occupancy, send notifications to occupants, etc.

In some cases, a single security event may result in a first threat level; however, a subsequent or additional security event may increase or decrease the threat level. For example, a first security event may be a motion sensor activating which results in a low threat level; however, shortly after the motion sensor activates, the system detects the opening of a window. Thus, the second security event (i.e., opening the window), combined with the first security event (i.e., detecting motion), may escalate the threat level to medium. Shortly after detecting the opening of the window, an indoor biometric sensor may determine the presence of an unauthorized person. The addition of the third security event, combined with the first two, may escalate the threat level to high. Although the three events combined may result in a high threat level, any other combination of the events, or each of the events individually, may not result in a high threat level. Thus, the system may determine which events, during which time, for which duration, in which order, and in which combination result in which threat level and which subsequent actions are taken.

Although the discussion provides for an escalating threat level, the system may also deescalate the threat level in a similar fashion. For example, a first security event may be the activation of a motion sensor resulting in a low threat level. Next, the second security event may be determining a window opening, resulting in a medium threat level. Next, the biometric sensor may determine that the person entering the house through the window is the teenage son returning home late at night, returning the threat level to a lower threat level or no threat level. Despite the deescalating threat level, the system may still prepare a security event report for review.

Depending on the escalating or deescalating threat levels, different alarm states and actions are taken. As described previously, a low threat level may result in informational and/or cautionary actions such as push notifications or increased sensor sensitivity. A medium threat level may result in turning lighting on or off, locking doors, alarming a different security system, issuing a quieter audible alarm (e.g., a soft beep), providing options for a user on an interactive panel to provide more information or confirm a situation, etc. A high threat level, however, may result in a full alarm (e.g., flood lights, sirens, audible warnings) as well as communication with other occupants, neighbors, security providers, and/or emergency services.

Broadcast component 320 may broadcast a notification related to the security event and/or the threat level and/or the alarm state to a plurality of possible people and devices. The notification may be audible, such as an automated voice broadcasting a warning based on determining security situations. For example, if the system detects an unauthorized person has entered the house, the system may have speakers throughout the house which broadcast an audible message stating: "Warning—unauthorized person detected in the living room." Occupants may record their own security event, threat level, and alarm state messages, or the system may use default recordings.

The broadcast component 320 may also enable an audible alarm, such as a siren, a beep, a series of beeps, buzzers, and the like. Depending on the security event and/or the threat level, the number of alarms, the pitch of the alarms, the volume of the alarms, and the like may vary. For example, if the security event or events result in a low threat level, a single quiet beep or a conversational-volume level audible statement may be issued. In contrast, if the security event or events result in a high threat level, multiple loud beeps or sirens may issue. In other embodiments, between the lowest threat level and the highest threat level, any level of, combination of, or number of alerts may be broadcast.

The broadcast component 320 may also initiate alarm actions based on the threat level such as feigning occupancy by way of turning on or off lights, playing music or other sounds (e.g., television), locking doors, increasing a recording rate of video, recording conversations and sounds, initiating biometric readings, monitoring communications such as outgoing and incoming phone calls and video calls, and transmitting data to other computing devices. Alarms facilitated by broadcast component 320 may also include occupant- or situation-specific audible tones and light colors, activation of appliances, personalized lighting settings, HVAC settings, and the like.

In some examples, the broadcast component 320 may facilitate a user-entered or user-selected broadcast. For example, if an occupant receives notification of a security event, either in her own home or curtilage, or at a neighbor's house, or at a location that would affect her security, or if the control panel 135 receives data indicative of a security event as described here, the system may display an interactive panel with which the occupant can select an action. In one embodiment, the interactive panel may be displayed on the smart home system panel, for example, an interactive panel mounted on a wall or other surface in a person's home. In other embodiments, the interactive panel may be displayed on local computing device 120 and/or remote computing device 140.

The interactive panel (e.g., interactive user interface) may enable user input of default preferences, household preferences for a plurality of different security events in and around the house, household preferences for a plurality of different security events affecting the house and occupants but not located at the house, individual occupant preferences for security events occurring inside the house and outside the house, and the like. In addition, the interactive panel may enable occupants to manually input the location and status of other occupants. In other examples, the interactive panel may enable occupants to manually input a security event the occupant has witnessed personally; for example, a person lurking in the backyard, a suspicious noise, an event across the street, etc.

In cases where a security event is determined, the interactive panel may display a notification providing information to the occupant regarding the security event; for example, a description of what is sensed, the location, the time, a list of user preferences associated with the security event, and the like. In response, the occupant can make a decision regarding the security event; for example, the occupant may dismiss the notification because she knows that it is not a security issue, may confirm that the security event is a security event, may manually indicate a threat level, may manually activate an alarm state, may manually initiate an alarm action (e.g., activate a siren, flash lights, initiate a communication, close and lock doors), and the like. In some cases, the interactive panel may present a selectable option to call a security dispatch center, the police, the fire department, medical help, a neighbor, someone from a pre-determined contact list, a contact list that populates from detecting the presence of a nearby computing device, and the like. In addition, the interactive panel may enable the occupant to use the panel as an intercom system; the occupant may speak through the interactive panel to warn an intruder or someone else in the house, etc. The occupant may also initiate a video call or an audio call, may receive a video and/or audio feed from the location of the security event or another location (e.g., the location where a child is located).

In other examples, the broadcast component 320 may prepare and/or may provide an event report for a security event or a summary report of multiple security events. In some examples, the report may also contain the past, present, and expected locations of occupants. The report may be transmitted to a local or remote computing device (including occupants' devices or third-parties, such as emergency services, the police, a homeowners' association, etc.). In other examples, the report may be stored at the control panel 135, on local computing device 120, on remote computing device 140, and/or on server 155. The occupant may view, edit, and/or share the report from any of the devices contemplated. Based on the report, occupants and other users may communicate with one another to discuss events that have occurred and refine user preferences or make other adjustments and decisions.

Figure 4:
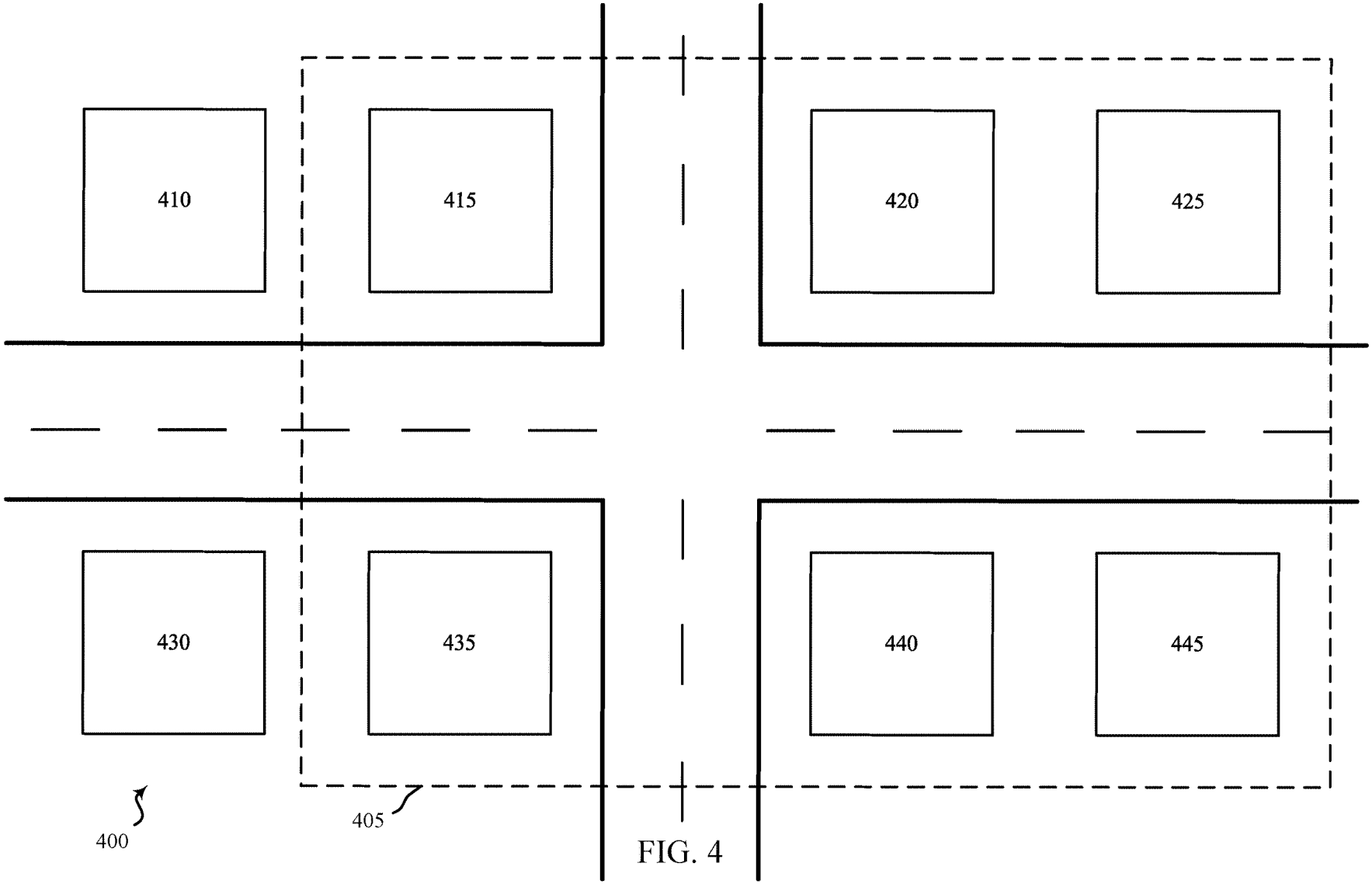
FIG. 4 shows a block diagram of a neighborhood relating to an example security and automation system, in accordance with one or more aspects of the present disclosure.

FIG. 4 shows a block diagram 400 relating to an example a security and automation system, in accordance with one or more aspects of the present disclosure. In particular, FIG. 4 shows an example residential neighborhood 400 having eight houses 410, 415, 420, 425, 430, 435, 440 and 445. Although FIG. 4 shows an example residential neighborhood with houses located within a geographic area of one another, it should be understood that neighborhood 400 may be a residential area, a commercial area, a rural area, and/or a mixed use area. In addition, the houses 410-445 may be any type of structures, and the structures need not be located next to one another, but rather may be located in different geographic locations separated by any contemplated distance (e.g., same sub-division, same commercial block, same multi-unit building, different sub-divisions, different commercial blocks, located on the same street but separated by one or miles). The systems and methods described herein relate to the example residential neighborhood 400, but the system and methods are not limited to neighborhood 400.

In neighborhood 400, any of the eight houses 410-445 may be coupled to at least one sensor (e.g., an audio/video device, such as a security and/or doorbell camera, vibration sensor, biometric sensor, motion sensor) in wireless communication with at least one sensor and/or computing device associated at another house; however, not all the devices may be in wireless communication with each other. Dotted line 405 shows a grouping of houses which are wirelessly networked to communicate with at least one other house located within the dotted line 405 by way of at least one audio/video device located at and/or associated with houses 415, 420, 425, 430, 435, 440, and/or 445. In this example, the six houses that are in networked wireless communication with each other are shown to be next to one another, however, the networked houses need not be next to each other. For example, houses 415, 420, 440, and 445 may be wirelessly networked in another example. In another example, any or some of the houses shown in within dotted line 405 may also be in wireless communication with a house (e.g., based on a device associated with and/or located at a house communicating with a device associated with a second house) that is not shown in FIG. 4.

Thus, in one example, the devices and/or houses may be part of a network based on proximity within a location; however, in other examples, the devices may be part of a network based on a specific association. For example, a community network may include a neighborhood-based social network, a social group network, an opt-in network that is not proximity based, an opt-in network that is proximity based, an automatically established network link based on location and proximity (e.g., portable electronic device running an application enters a building enabled to perform the methods described herein). For example, houses 415, 420, 425, 435, 440, and 445 may all be part of a homeowners' association, where houses 410 and 430 are not part of the same homeowners' association, even though houses 410 and 430 are located in the same neighborhood.

Each of the devices associated with the location of each of the houses may share any or all of the same capabilities as each other device. For example, a device associated with house 415 may be enabled to obtain data from a first sensor at house 415. House 415 may be the house described previously with respect to FIGS. 1-3. The sensor may be physically integrated as part of the device and/or may be in wired and/or wireless communication with the device. The data obtained by the sensor may include: biometric and personal data such as fingerprints, retinal scans, facial scans, gait, height, weight, speed, cadence, hair color, hair length, presence of facial hair, tattoos, piercings, jewelry, clothing style, clothing color, voice recordings, personal identification numbers, radio frequency data related to a radio frequency identification (RFID) tag associated with a person, identification of an electronic device such as a smartphone, table, or wearable electronic device, and the like.

The sensor may also obtain data related to animals, vehicles, environment, and non-tangible items, such car types, delivery vehicles, company logos, identification card data, rain, wind, sounds related to walking, running, talking, screaming, laughing, wind, glass breaking, doors opening and closing, sirens, alarms, etc. which are determined to be within a predetermined proximity of example house 415.

In addition, the device may receive identification data related to a person or an event at or within a predetermined distance of example house 415. For example, with respect to a person, the device may associate or compare the data obtained from the sensor with a plurality of user profiles associated with house 415 or past data. In other examples, the user profiles may be associated with other houses in the neighborhood which are in networked communication with one another. The user profiles may be profiles of an allowed and/or expected users and/or guests at example house 415, or other networked houses. The user profiles may be stored individually for each house and/or combined into a database for some and/or all of the networked devices. Some profiles, sensor data, determinations, comparisons, or other information may be shared with some devices with user permission or based on user preferences. For example, in the case of an emergency or a detected security event, more profile data may be shared with more of the networked devices within the area indicated by dotted line 405. If the user interacts with the system using a software application (such as on a smartphone or a control panel), the software application may query the user on what, if any, information the user would like to share with the rest of the networked users.

In other examples, other identification data related to a person may be received from remote and/or third-party databases and/or reports and/or broadcasts and/or publications. For example, identification data from a criminal database, missing child and/or persons database, newspaper articles, news broadcasts, radio broadcasts, television broadcasts, digital streaming broadcasts, and the like.

With respect to a security event, the device may associate the data obtained from the sensor with predetermined, pre-stored, and/or computer learning algorithmic determined elements related to one or more security events. For example, the device may obtain information related to opening and closing a door, window, gate, garage door, blinds; a vehicle ignition starting, turning off, speeding, idling, swerving, crashing; weather data such as rain, wind, snow, hail; glass breaking; talking, screaming, laughing, etc., located within a predetermined distance of example house 415. Based on the data received, user input, changes in preferences, and/or communication from and between other devices, each device may learn the association between obtained data and/or identification data which may not have been previously predetermined or preprogrammed into the system.

The device may compare the data obtained with identification data received to determine if a security event has occurred and/or if an identified or non-identified (or authorized or unauthorized) person is associated with the event. In some examples, the person and/or the event may be allowed and/or expected, while in other examples, the person and/or the event may be unauthorized, and thus may be determined to be a security event. In other examples, the person and/or event may not be able to be determined and/or identified; however, through computer learning algorithms and other input, over time, the device may be able to identify people and/or events over time, and thus determine that the identification of a person or event does not qualify as a security event.

Based on data received from sensors associated with another house in the neighborhood, or other information obtained from sources described above, the system may determine a threat level for house 415, and consequently may activate an alarm state based on the threat level. As described previously, the data received from other sources and other houses may be used to determine a security event, a threat level, and/or an alarm state based on the user preferences of an occupant or multiple occupants at house 415. An increased threat level at a neighboring house may result in an increased threat level at house 415 and vice versa. Similarly, a decreased threat level at a neighboring house may result in a decreased threat level at hours 415 and vice versa. In some embodiments, an increased (or decreased) threat level at a neighboring house may be determined based on the neighboring house occupants' user preferences; thus, the same security events which determine a threat level at a neighboring house may not result in the same threat level at house 415 due to differing user preferences. In some embodiments, the threat level at a neighboring house in and of itself may be used to determine a threat level at house 415.

For example, where the system receives an indication that house 445 has an unexpected visitor, the occupants of house 415 may have a user preference which indicates that an unexpected visitor at house 445 is not a security event. However, the occupants of house 415 may have a user preference which indicates that an unexpected visitor at house 410 is a security event, as house 410 is next door to house 415. In another example, the occupants of house 415 may be aware that the occupants of house 410 have a dog, but that the dog always barks when someone walks by. Thus, an indication that the dog of house 410 is barking may not rise to the level of a security event in the minds of the occupants of house 415. In contrast, however, the occupants of house 435 may have a well-trained dog that only barks if there is a problem; thus, the occupants of house 445 may have a user preference which determines a barking dog at house 435 is indicative of a security event.

Data received from or associated with other houses or received from third parties may be considered similarly to data and security events determined within the house. Thus, data from other sources may result in determining the existence of a first or additional security event, may result in creating or alerting a threat level, and may result in activating or deactivating an alarm state. In some embodiments, data received from third parties may result in sending a notification to an occupant of house 415, or may result in the system of or occupant of house 415 sending a notification to a third party, including another house in the neighborhood. Notifications may also include the system of or an occupant of house 415 communicating with an emergency service with respect to a security event determined at another location.

Figure 5:
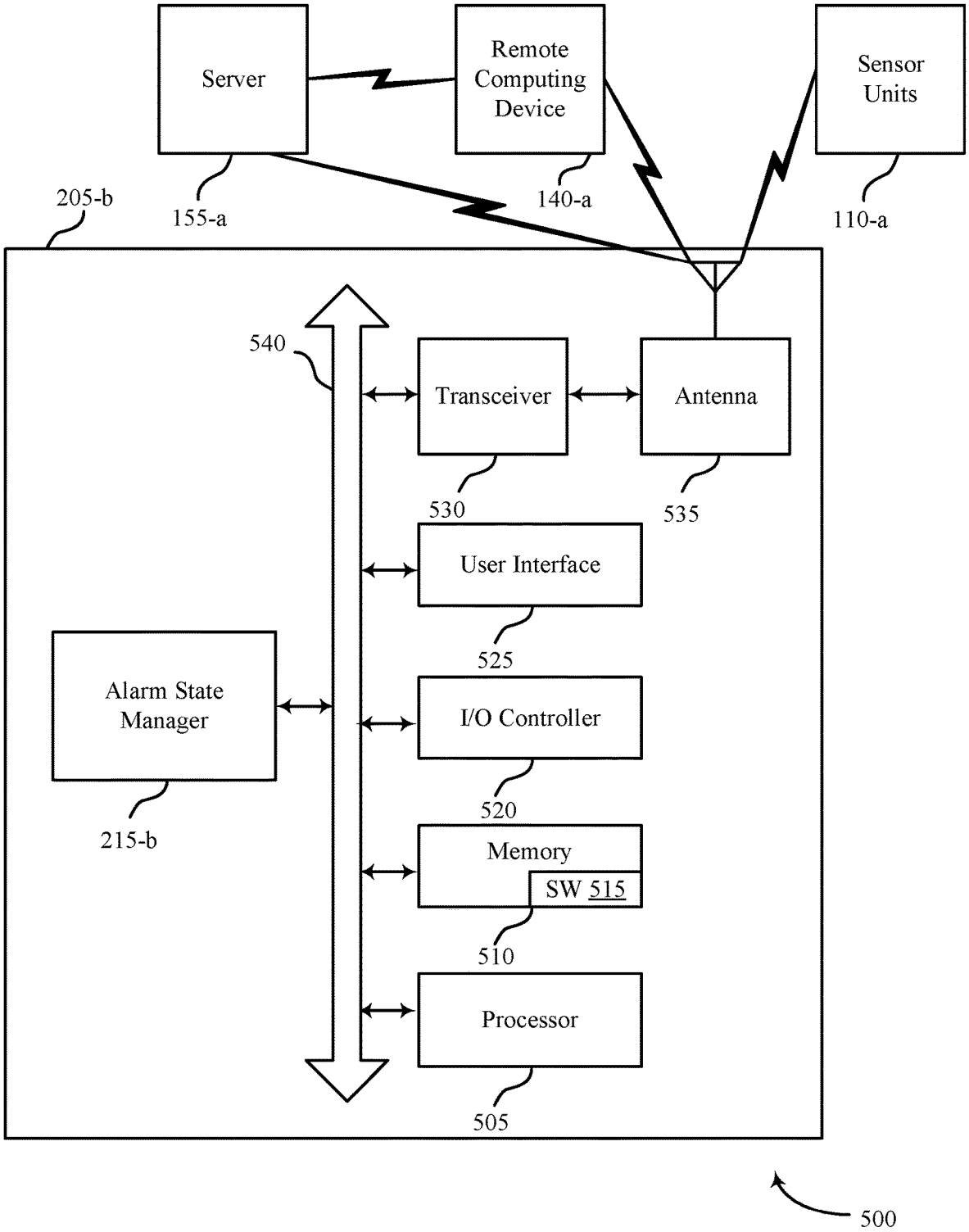
FIG. 5 shows a block diagram of an apparatus relating to an example security and automation system, in accordance with one or more aspects of the present disclosure.

FIG. 5 shows a block diagram 500 of an apparatus 205-*c* relating to a security and automation system, in accordance with one or more aspects of the present disclosure. Apparatus 205-*c* may be an example of the control panel 135, local computing device 120, and/or the sensor units 110 of FIG. 1. In some examples, apparatus 205-*b* may also be an example of one or more aspects of apparatus 205 and/or 205-*a* with reference to FIGS. 2-5.

Apparatus 205-*b* may include an alarm state manager 215-*b* which may be an example of the alarm state manager 215 and/or 215-*a* described with reference to FIGS. 2 and 3. The alarm state manager 215-*c* may provide techniques for initiating an alarm state based on determining a security event (and in some cases, considering user preferences), as described above with reference to FIGS. 1-4.

Apparatus 205-*b* may also include components for bi-directional data communications including components for transmitting communications and components for receiving communications. For example, apparatus 205-*b* may communicate bi-directionally with remote computing device 140-*a*, server 155-*a*, or sensor units 110-*a*. This bi-directional communication may be direct (e.g., apparatus 205-*b* communicating directly with sensor units 110-*a* or remote computing device 140-*a*) or indirect (e.g., apparatus 205-*a* communicating with remote computing device 140-*a* via server 155-*a*). Server 155-*a*, remote computing device 140-*a*, and sensor units 110-*a* may be examples of server 155, remote computing device 140, and sensor units 110 as shown with respect to FIG. 1.

Apparatus 205-*b* may also include a processor 505, and memory 510 (including software (SW) 515), an input/output (I/O) controller 520, a user interface 525, a transceiver 530, and one or more antennas 535, each of which may communicate—directly or indirectly—with one another (e.g., via one or more buses 540). The transceiver 530 may communicate bi-directionally—via the one or more antennas 535, wired links, and/or wireless links—with one or more networks or remote devices as described above. For example, the transceiver 530 may communicate bi-directionally with one or more of server 155-*a* or sensor unit 110-*a*. The transceiver 530 may include a modem to modulate the packets and provide the modulated packets to the one or more antennas 535 for transmission, and to demodulate packets received from the one or more antennas 535. While an apparatus 205-*b* may include a single antenna 535, the apparatus may also have multiple antennas 535 capable of concurrently transmitting or receiving multiple wired and/or wireless transmissions. In some embodiments, one element of apparatus 205-*b* (e.g., one or more antennas 535, transceiver 530, etc.) may provide a direct connection to a server 155-*a* via a direct network link to the Internet via a POP (point of presence). In some embodiments, one element of apparatus 205-*b* (e.g., one or more antennas 535, transceiver 530, etc.) may provide a connection using wireless techniques, including digital cellular telephone connection, Cellular Digital Packet Data (CDPD) connection, digital satellite data connection, and/or another connection.

The signals associated with apparatus 205-*b*, server 155-*a*, remote computing device 140-*a*, and/or sensor unit 110-*a* may include wireless communication signals such as radio frequency, electromagnetics, local area network (LAN), wide area network (WAN), virtual private network (VPN), wireless network (using 802.11, for example), 345 MHz, Z Wave, cellular network (using 3G and/or LTE, for example), and/or other signals. The one or more antennas 535 and/or transceiver 530 may include or be related to, but are not limited to, wireless wide area network (WWAN) (GSM, CDMA, and WCDMA), WLAN (including Bluetooth and Wi-Fi), WMAN (WiMAX), antennas for mobile communications, antennas for Wireless Personal Area Network (WPAN) applications (including radio-frequency identification (RFID) and ultra-wideband (UWB)). In some embodiments, each antenna 535 may receive signals or information specific and/or exclusive to itself. In other embodiments each antenna 535 may receive signals or information neither specific nor exclusive to itself.

In some embodiments, the user interface 525 may include an audio device, such as an external speaker system, a visual device such as a camera or video camera, an external display device such as a display screen, and/or an input device (e.g., remote control device interfaced with the user interface 525 directly and/or through I/O controller 520). In some examples, one or more buses 540 may allow data communication between one or more elements of apparatus 205-*b* (e.g., processor 505, memory 510, I/O controller 520, user interface 525, etc.).

The memory 510 may include random access memory (RAM), read only memory (ROM), flash RAM, and/or other types. The memory 510 may store computer-readable, computer-executable software/firmware code 515 including instructions that, when executed, cause the processor 505 to perform various functions described in this disclosure (e.g., analyzing the authentication credentials, transmitting a message to a remote device, etc.). Alternatively, the computer-executable software/firmware code 515 may not be directly executable by the processor 505 but may cause a computer (e.g., when compiled and executed) to perform functions described herein.

In some embodiments the processor 505 may include, among other things, an intelligent hardware device (e.g., a central processing unit (CPU), a microcontroller, and/or an ASIC, etc.). The memory 510 may contain, among other things, the Basic Input-Output system (BIOS) which may control basic hardware and/or software operation such as the interaction with peripheral components or devices. For example, the alarm state manager 215-*b* may be stored within the memory 510. Applications resident with apparatus 205-*b* are generally stored on and accessed via a non-transitory computer readable medium, such as a hard disk drive or other storage medium. Additionally, applications may be in the form of electronic signals modulated in accordance with the application and data communication technology when accessed via a network interface (e.g., transceiver 530, one or more antennas 535, etc.).

Many other devices and/or subsystems may be connected to, or may be included as, one or more elements of apparatus 205-*b* (e.g., entertainment system, computing device, remote cameras, wireless key fob, wall mounted user interface device, cell radio module, battery, alarm siren, door lock, lighting system, thermostat, home appliance monitor, utility equipment monitor, and so on). In some embodiments, all of the elements shown in FIG. 4 need not be present to practice the present systems and methods. The devices and subsystems can be interconnected in different ways from that shown in FIG. 5. In some embodiments, an aspect of some operation of a system, such as that shown in FIG. 5, may be readily known in the art and is not discussed in detail in this disclosure. Code to implement the present disclosure may be stored in a non-transitory computer-readable medium such as one or more of memory 510 or other memory. The operating system provided on I/O controller 420 may be iOS®, ANDROID®, MS-dOS®, MS-WINDOWS®, OS/2®, UNIX®, LINUX®, or another known operating system.

The components of the apparatus 205-*b* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

Figure 6:
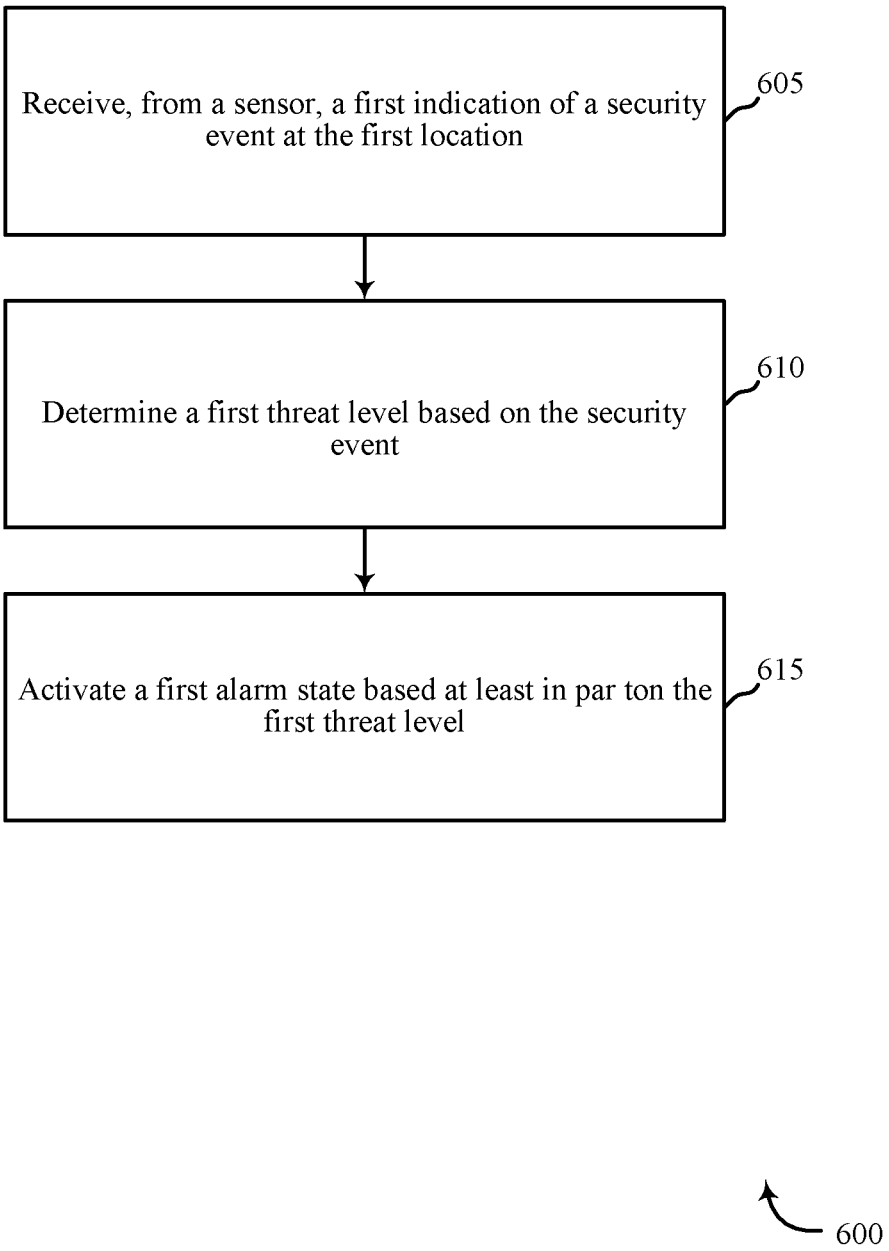
FIG. 6 is a flow chart illustrating an example of a method relating to a security and automation system, in accordance with one or more aspects of the present disclosure.

FIG. 6 is a flow chart illustrating an example of a method 600 relating to a security and/or an automation system, in accordance with one or more aspects of the present disclosure. For clarity, the method 600 is described below with reference to aspects of one or more of the sensor units 110, local computing device 120, control panel 135, and/or remote computing device 140 as described with reference to at least FIG. 1. In addition, method 600 is described below with reference to aspects of one or more of the apparatus 205, 205-*a*, and 205-*b* described with reference to at least FIGS. 2-5. In some examples, control panel 135, local computing device 120, and/or sensor units 110 may execute one or more sets of codes to control the functional elements described below. Additionally or alternatively, the control panel 135, local computing device 120, and/or sensor units 110 may perform one or more of the functions described below using special-purpose hardware.

At block 605, the method 600 may include receiving, from a sensor, a first indication of a security event at the first location. A security event may include determining a presence of an unauthorized person at the first location and/or determining an unexpected open door, an unexpected open window, an unexpected sound, an unexpected movement, or a combination thereof. The operation at block 605 may be performed using the alarm state manager 215, security event component 305, control panel 135, sensor units 110, or apparatus 205, 205-*a*, and/or 205-*b* described with reference to FIGS. 1-5.

At block 610, the method 600 may include determining a first threat level based on the security event. A first threat level may include, but is not limited to a threat that results in informing an occupant about an anomaly, and may further include asking an occupant for input regarding a subsequent action. In other embodiments, the first threat level may escalate from a low level to an emergency level based at least in part on the security event and, in some cases, user preferences. The operation at block 610 may be performed using the alarm state manager 215, threat level component 310, use sensing component 315, control panel 135, sensor units 110, or apparatus 205, 205-*a* and/or 205-*b* described with reference to FIGS. 1-5.

At block 615, the method 600 may include activating a first alarm state based at least in part on the first threat level. In some examples, the first alarm state may include sending a notification to an occupant, flashing or blinking lights, changing the colors of lights, emitting audible alerts of varying lengths and volumes, communicating with third parties, including emergency services, and the like. The operation at block 610 may be performed using the alarm state manager 215, threat level component 310, use sensing component 315, broadcast component 320, control panel 135, sensor units 110, or apparatus 205, 205-*a* and/or 205-*b* described with reference to FIGS. 1-5.

Figure 7:
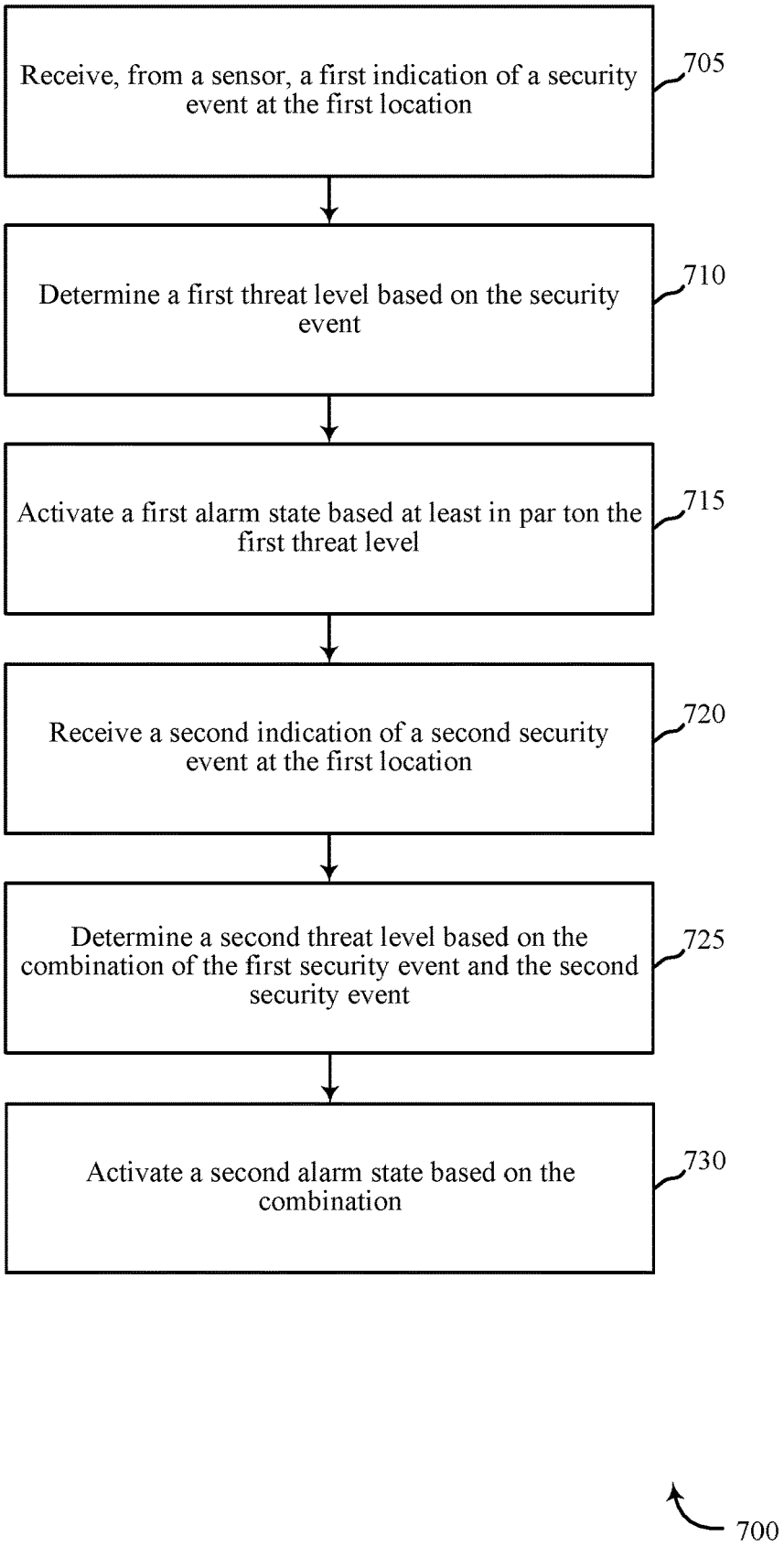
FIG. 7 is a flow chart illustrating an example of a method relating to a security and automation system, in accordance with one or more aspects of the present disclosure.

FIG. 7 is a flow chart illustrating an example of a method 700 relating to a security and/or an automation system, in accordance with one or more aspects of the present disclosure. For clarity, the method 700 is described below with reference to aspects of one or more of the sensor units 110, local computing device 120, control panel 135, and/or remote computing device 140 as described with reference to at least FIG. 1. In addition, method 700 is described below with reference to aspects of one or more of the apparatus 205, 205-*a*, and 205-*b* described with reference to at least FIGS. 2-5. In some examples, control panel 135, local computing device 120, and/or sensor units 110 may execute one or more sets of codes to control the functional elements described below. Additionally or alternatively, the control panel 135, local computing device 120, and/or sensor units 110 may perform one or more of the functions described below using special-purpose hardware.

At block 705, the method 700 may include receiving, from a sensor, a first indication of a security event at the first location. In some aspects, block 705 may be synonymous with block 605 described previously with respect to FIG. 6. At block 710, the method 700 may include determining a first threat level based on the security event. At block 715, the method 700 may include activating a first alarm state based at least in part on the first threat level. Blocks 710 and 715 may be synonymous with blocks 610 and 615, respectively, described previously with respect to FIG. 6.

At block 720, the method 700 may include receiving a second indication of a second security event at the first location. A second indication of a second security event at the first location may be a second event which indicates an escalating security situation; for example, the first indication of a first security event from block 600 may be indicative of an unauthorized person at the front door, where a second indication of a second security event is the door being opened unexpectedly or the sound of a window breaking. The operation at block 720 may be performed using the alarm state manager 215, security event component 305, control panel 135, sensor units 110, or apparatus 205, 205-*a*, and/or 205-*b* described with reference to FIGS. 1-5.

At block 725, the method 700 may include determining a second threat level based on the combination of the first security event and the second security event. Continuing the example from block 720, the combination of the first security event and the second security event may result in determining a second threat level—the first threat level may have been lower than the second level based on the fact a person is now likely to be determined to be breaking into the house. In some embodiments, the second security event may result in a higher threat level, but in other embodiments, the second security event may result in a lower threat level. The operation at block 725 may be performed using the alarm state manager 215, threat level component 310, use sensing component 315, control panel 135, sensor units 110, or apparatus 205, 205-*a* and/or 205-*b* described with reference to FIGS. 1-5.

At block 730, the method 700 may include activating a second alarm based on the combination. Based on the change in threat level, the second alarm may be lessened or escalated. Continuing the example from blocks 720 and 730, the first alarm may be a notification sent to an occupant that an unauthorized person is at the door; the second alarm may be an audible alarm sounding inside the house or flashing the front porch lights on and off. The operation at block 730 may be performed using the alarm state manager 215, threat level component 310, use sensing component 315, broadcast component 320, control panel 135, sensor units 110, or apparatus 205, 205-*a* and/or 205-*b* described with reference to FIGS. 1-5.

In some examples, aspects from two or more of the methods 500 and 600 may be combined and/or separated. It should be noted that the methods 500 and 600 are just example implementations, and that the operations of the methods 500 and 600 may be rearranged or otherwise modified such that other implementations are possible.

The detailed description set forth above in connection with the appended drawings describes examples and does not represent the only instances that may be implemented or that are within the scope of the claims. The terms "example" and "exemplary," when used in this description, mean "serving as an example, instance, or illustration," and not "preferred" or "advantageous over other examples." The detailed description includes specific details for the purpose of providing an understanding of the described techniques. These techniques, however, may be practiced without these specific details. In some instances, known structures and apparatuses are shown in block diagram form in order to avoid obscuring the concepts of the described examples.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and components described in connection with this disclosure may be implemented or performed with a general-purpose processor, a digital signal processor (DSP), an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, and/or state machine. A processor may also be implemented as a combination of computing devices, e.g., a combination of a DSP and a microprocessor, multiple microprocessors, one or more microprocessors in conjunction with a DSP core, and/or any other such configuration.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

In addition, any disclosure of components contained within other components or separate from other components should be considered exemplary because multiple other architectures may potentially be implemented to achieve the same functionality, including incorporating all, most, and/or some elements as part of one or more unitary structures and/or separate structures.

Computer-readable media includes both computer storage media and communication media including any medium that facilitates transfer of a computer program from one place to another. A storage medium may be any available medium that can be accessed by a general purpose or special purpose computer. By way of example, and not limitation, computer-readable media can comprise RAM, ROM, EEPROM, flash memory, CD-ROM, DVD, or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk and Blu-ray disc where disks usually reproduce data magnetically, while discs reproduce data optically with lasers. Combinations of the above are also included within the scope of computer-readable media.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the broadest scope consistent with the principles and novel features disclosed.

This disclosure may specifically apply to security system applications. This disclosure may specifically apply to automation system applications. In some embodiments, the concepts, the technical descriptions, the features, the methods, the ideas, and/or the descriptions may specifically apply to security and/or automation system applications. Distinct advantages of such systems for these specific applications are apparent from this disclosure.

The process parameters, actions, and steps described and/or illustrated in this disclosure are given by way of example only and can be varied as desired. For example, while the steps illustrated and/or described may be shown or discussed in a particular order, these steps do not necessarily need to be performed in the order illustrated or discussed. The various exemplary methods described and/or illustrated here may also omit one or more of the steps described or illustrated here or include additional steps in addition to those disclosed.

Furthermore, while various embodiments have been described and/or illustrated here in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may permit and/or instruct a computing system to perform one or more of the exemplary embodiments disclosed here.

This description, for purposes of explanation, has been described with reference to specific embodiments. The illustrative discussions above, however, are not intended to be exhaustive or limit the present systems and methods to the precise forms discussed. Many modifications and variations are possible in view of the above teachings. The embodiments were chosen and described in order to explain the principles of the present systems and methods and their practical applications, to enable others skilled in the art to utilize the present systems, apparatus, and methods and various embodiments with various modifications as may be suited to the particular use contemplated.

What is claimed is:

1. A method for an automation and/or security system, comprising:

receiving, from a sensor at a first location, an indication of a security event at the first location;

determining a first threat level associated with the security event at the first location;

identifying a second location associated with a same profile as the first location, wherein the first location and the second location are each located within a same neighborhood; and transmitting an alert comprising the first threat level to an automation or security system associated with the second location based at least in part on determining the first threat level associated with the security event at the first location.

2. The method of claim 1, further comprising:

comparing the indication of the security event at the first location with a profile specific to the first location, the profile specific to the first location comprising one or more settings associated with an automation or security system associated with the first location, wherein determining the first threat level associated with the security event at the first location is based at least in part on comparing the indication of the security event at the first location with the profile specific to the first location.

3. The method of claim 2, further comprising:

comparing the indication of the security event at the first location with a database comprising a plurality of known security events, wherein determining the first threat level is based at least in part on comparing the indication of the security event at the first location with the database comprising a plurality of known security events.

4. The method of claim 1, further comprising:

identifying a plurality of locations associated with the same profile as the first location, wherein each of the plurality of locations are located within the same neighborhood as the first location and the second location; and transmitting the alert to an automation or security system associated with each of the plurality of locations.

5. The method of claim 1, wherein determining the first threat level comprises:

determining a type of the security event at the first location, wherein the alert is based at least in part on the type of the security event at the first location.

6. The method of claim 1, further comprising:

transmitting the alert comprising the first threat level to an automation or security system associated with a location outside of the neighborhood based at least in part on determining the first threat level, wherein the location outside of the neighborhood is associated with the same profile as the first location and the second location.

7. The method of claim 1, further comprising:

receiving, from the automation or security system associated with the first location, a response message based at least in part on determining the first threat level associated with the security event at the first location, wherein the response message comprises an indication that the security event is resolved; and transmitting a second alert to the automation or security system associated with the second location based at least in part on receiving the response message.

8. The method of claim 7, wherein the alert comprises an indication of a type of the security event at the first location, and wherein the second alert comprises an indication that the type of the security event is resolved.

9. An apparatus for security and/or automation systems, comprising a processor;

memory in electronic communication with the processor; and instructions stored in the memory, the instructions being executable by the processor to:

receive, from a sensor at a first location, an indication of a security event at the first location;

determine a first threat level associated with the security event at the first location;

identify a second location associated with a same profile as the first location, wherein the first location and the second location are each located within a same neighborhood; and transmit an alert comprising the first threat level to an automation or security system associated with the second location based at least in part on determining the first threat level associated with the security event at the first location.

10. The apparatus of claim 9, wherein when the processor determines the first threat level, the instructions are further executable to:

compare the indication of the security event at the first location with a profile specific to the first location, the profile specific to the first location comprising one or more settings associated with an automation or security system associated with the first location, wherein determining the first threat level associated with the security event at the first location is based at least in part on comparing the indication of the security event at the first location with the profile specific to the first location.

11. The apparatus of claim 10, wherein the instructions are further executable by the processor to:

compare the indication of the security event at the first location with a database comprising a plurality of known security events, wherein determining the first threat level is based at least in part on comparing the indication of the security event at the first location with the database comprising a plurality of known security events.

12. The apparatus of claim 9, wherein the instructions are further executable by the processor to:

identify a plurality of locations associated with the same profile as the first location, wherein each of the plurality of locations are located within the same neighborhood as the first location and the second location; and transmit the alert to an automation or security system associated with each of the plurality of locations.

13. The apparatus of claim 9, wherein determining the first threat level comprises:

determining a type of the security event at the first location, wherein the alert is based at least in part on the type of the security event at the first location.

14. The apparatus of claim 9, wherein the instructions are further executable by the processor to:

transmit the alert comprising the first threat level to an automation or security system associated with a location outside of the neighborhood based at least in part on determining the first threat level, wherein the location outside of the neighborhood is associated with the same profile as the first location and the second location.

15. The apparatus of claim 9, wherein the instructions are further executable by the processor to:

receive, from the automation or security system associated with the first location, a response message based at least in part on determining the first threat level associated with the security event at the first location, wherein the response message comprises an indication that the security event is resolved; and transmit a second alert to the automation or security system associated with the second location based at least in part on receiving the response message.

16. The apparatus of claim 15, wherein the alert comprises an indication of a type of the security event at the first location, and wherein the second alert comprises an indication that the type of the security event is resolved.

17. A non-transitory computer-readable medium storing computer-executable code, the code executable by a processor to:

receive, from a sensor at a first location, an indication of a security event at the first location;

determine a first threat level associated with the security event at the first location;

identify a second location associated with a same profile as the first location, wherein the first location and the second location are each located within a same neighborhood; and transmit an alert comprising the first threat level to an automation or security system associated with the second location based at least in part on determining the first threat level associated with the security event at the first location.

18. The non-transitory computer-readable medium storing computer-executable code of claim 17, wherein the code is executable by the processor to:

compare the indication of the security event at the first location with a profile specific to the first location, the profile specific to the first location comprising one or more settings associated with an automation or security system associated with the first location, wherein determining the first threat level associated with the security event at the first location is based at least in part on comparing the indication of the security event at the first location with the profile specific to the first location.

19. The non-transitory computer-readable medium storing computer-executable code of claim 18, wherein the code is executable by the processor to:

compare the indication of the security event at the first location with a database comprising a plurality of known security events, wherein determining the first threat level is based at least in part on comparing the indication of the security event at the first location with the database comprising a plurality of known security events.

20. The non-transitory computer-readable medium storing computer-executable code of claim 17, wherein the code is executable by the processor to:

identify a plurality of locations associated with the same profile as the first location, wherein each of the plurality of locations are located within the same neighborhood as the first location and the second location; and transmit the alert to an automation or security system associated with each of the plurality of locations.

* * * * *